US006901893B1

(12) United States Patent
Gumpher

(10) Patent No.: US 6,901,893 B1
(45) Date of Patent: Jun. 7, 2005

(54) VALVE DEACTIVATOR ASSEMBLY

(75) Inventor: Eric W. Gumpher, Tallahassee, FL (US)

(73) Assignee: Stanadyne Corporation, Windsor, CT (US)

( * ) Notice: Subject to any disclaimer, the term of this patent is extended or adjusted under 35 U.S.C. 154(b) by 0 days.

(21) Appl. No.: 10/824,813

(22) Filed: Apr. 15, 2004

(51) Int. Cl.[7] ..... F01L 1/34
(52) U.S. Cl. ..... 123/90.16; 123/90.15; 123/90.52; 123/90.55
(58) Field of Search ..... 123/90.16, 90.15, 123/90.52, 90.55, 90.43

(56) References Cited

U.S. PATENT DOCUMENTS 6,164,255 A * 12/2000 Maas et al. ..... 123/90.16
6,247,433 B1 * 6/2001 Faria et al. ..... 123/90.16
6,321,704 B1 11/2001 Church et al. ..... 123/90.16
6,578,535 B2 6/2003 Spath et al. ..... 123/90.16
6,595,174 B2 * 7/2003 Schnell ..... 123/90.55
6,668,776 B2 * 12/2003 Hendriksma et al. .... 123/90.16

* cited by examiner

*Primary Examiner*—Thomas Denion
*Assistant Examiner*—Zelalem Eshete
(74) *Attorney, Agent, or Firm*—Alix, Yale & Ristas, LLP

(57) ABSTRACT

A valve deactivator assembly according to aspects of the present invention includes an inner body member that is slidably disposed in a longitudinal bore defined by an outer body member. Two diametrically opposed pistons are positioned in a transverse bore also defined by the outer body member. A pair of substantially identical latch members are outwardly biased against an inner end of the pistons by a compressed spring. The latch members are generally semi-cylindrical in shape and include flat truncated semi-circular upper and lower surfaces. The pistons apply radially inward force in response to engine oil pressure to adjacent latch member to move the latch member against the bias of the compressed spring to an unlatched position. The periphery of each latch member lower surface provides arcuate shoulder portions that engage angularly separated portions of a latching surface inside the outer body member.

20 Claims, 3 Drawing Sheets

VALVE DEACTIVATOR ASSEMBLY

FIELD OF THE INVENTION

The present invention relates to an improved valve train for an internal combustion engine, and more particularly, to a valve deactivator assembly for use therein, and even more particularly, to such a valve deactivator of the type utilizing a hydraulically actuated latching arrangement.

BACKGROUND OF THE INVENTION

It is well known that overall fuel efficiency in a multiple-cylinder internal combustion engine can be increased by deactivation of the intake and/or exhaust valves for particular cylinders under certain engine load conditions. A known approach to providing selective valve deactivation in a push rod engine is to equip the lifters for the valves to be deactivated with means whereby the lifters are rendered incapable of transferring the cyclic motion of engine cams into reciprocal motion of the associated pushrods and valves. Typically, a deactivation lifter in a push rod engine includes concentric inner and outer portions which are mechanically responsive to the pushrod and to the cam lobe, respectively, and which may be selectively latched to each other.

When latched, the inner body member is rigidly supported in an extended position relative to the outer body member. A pre-determined engine oil pressure applied to the latch assembly moves latch members to an unlatched position. The unlatched inner body member collapses into the outer body member from its latched, extended position. The resulting lost motion prevents transmission of the reciprocal motion of the cam follower to the engine valve.

In push rod type valve trains, this type of valve deactivator assembly is incorporated into the cam follower so that the lost motion prevents the reciprocal motion of the cam follower from being delivered to the push rod. In overhead cam ("OHC") engines of the type utilizing an end pivot rocker arm, the pivot point for one end of the rocker arm is typically a hydraulic lash adjuster ("HLA"), with the opposite end of the rocker arm being in engagement with the valve stem. In the OHC valve train, the valve deactivator assembly is configured to produce lost motion at the HLA pivot point. Lost motion at the HLA pivot point prevents valve actuation by preventing force delivery to the engine valve stem.

Prior art valve deactivator assemblies have typically employed one or more spring-biased latch members that are responsive to fluid pressure to move from a radially outward latched position to a radially inward unlatched position. In these prior art assemblies, the latch member is itself acted on by the pressurized fluid and also engages a latching surface in the outer body member to support the inner body member in its extended latched position relative to the outer body member. In this type of prior art deactivator assembly, the latch members function as both hydraulically responsive members and reciprocating mechanical latches. The need to configure latch members to perform both of these functions has compromised and complicated latch assembly design.

U.S. Pat. Nos. 6,321,704 and 6,578,535 discuss the shortcomings of prior valve deactivator assemblies employing diametrically opposed latch members in the form of cylindrical pins. The pins are radially outwardly biased toward a latched position by a compressed spring. In their latched position, the locking pins are positioned in a groove and exposed to an engine oil gallery. Engine oil pressure applied to the outer ends of the pins compresses the spring, moving the pins radially inwardly to an unlatched position. These latch members have relatively small load-bearing latching surfaces, resulting in force concentrations and wear problems. The '704 and '535 patents address force concentrations at the pin/outer body interface by providing each pin with a flat surface complementary to a latching surface on the outer body member. The latching assemblies are then required to maintain the locking pins in a particular rotational position to maintain these flat surfaces parallel to the corresponding latching surface of the outer body member.

There is a need in the art for a reliable valve deactivator assembly of simplified design that provides a reliable and robust latching mechanism.

SUMMARY OF THE INVENTION

A valve deactivator assembly according to aspects of the present invention includes an inner body member that is slidably disposed in a longitudinal bore defined by an outer body member. Two diametrically opposed pistons are positioned in a transverse bore also defined by the outer body member. A pair of substantially identical latch members are outwardly biased against an inner end of the pistons by a compressed spring. In the disclosed embodiment, the latch members are generally semi-cylindrical in shape and include a radially outwardly projecting actuated surface adjacent the piston inner end. The pistons develop radially inward force in response to engine oil pressure applied to a gallery in fluid communication with the transverse bore. This radially inward force is delivered to the actuated surface of the adjacent latch member to move the latch member against the bias of the compressed spring to an unlatched position.

The semi-cylindrical latch members have large flat truncated semi-circular upper and lower surfaces. The latch member upper surfaces are in contact with the bottom of the inner body member. The periphery of each latch member lower surface provides arcuate shoulder portions that engage angularly separated portions of a latching surface inside the outer body member. The arcuate shoulder portions of the latch member extend laterally to either side of the radially outwardly projecting actuated surface. The two diametrically opposed latch members engage the latching surface at four angularly separated areas. This configuration spreads the force of valve actuation over a large surface area and distributes the force around the circumference of the outer body member, reducing the likelihood of force concentrations and fatigue failure over the life of the valve deactivator assembly.

The latch members are supported against the bottom of the inner body member by a plate-like latch support biased by a spring. When the deactivator assembly is unlatched, the generally cylindrical inner body member collapses into the axial bore of the outer body member against the bias of the spring, pushing the latch members and latch support past the transverse bore and pistons. An aspect of the invention relates to restricting inward motion of the pistons by limiting inward motion of the latch members. A stop limits inward motion of each latch member, which in turn limits inward motion of the adjacent piston. The radially inward or actuated position of the piston does not interfere with movement of the inner body member into the outer body member. As the inner body member, latch members and latch support collapse into the outer body member, the inner end of the pistons are continuously engaged by at least one of the latch member actuated surface or cylindrical outside surface of the inner body member. So long as a predetermined hydraulic pressure is applied to the outer end of the pistons, the latch members are maintained in their radially inward, unlatched position and cannot engage the latching surface.

An object of the present invention is to provide a new and improved latching mechanism for a valve deactivator assembly.

Another object of the present invention is to provide a new and improved latching mechanism for a valve deactivator assembly that prevents force concentrations in the assembly by spreading valve actuation loads.

DETAILED DESCRIPTION OF THE PREFERRED EMBODIMENT

Figure 2:
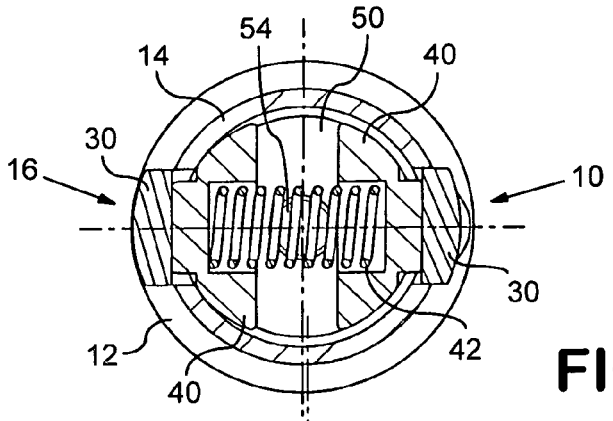
FIG. 2 is a horizontal sectional view of the valve deactivator assembly of FIG. 1, taken along line 2—2 thereof.

A preferred embodiment of the valve deactivator assembly will now be described with reference to FIGS. 1–8. The primary components of a valve deactivator assembly 10 according to aspects of the present invention are an outer body member 12, an inner body member 14 and a latch assembly 16. The generally cylindrical inner body member 14 is slidably received in a longitudinal bore 18 defined by the outer body member 12. In the illustrated embodiment, the inner body member supports a hydraulic lash adjuster (HLA) generally designated by the numeral 20, which may be of a type well known to those skilled in the art. The HLA 20 is not an essential feature of the invention, the function of which will not be described further herein. The upper end of the HLA is a ball plunger 22 that is typically received within a hemispherical socket of a rocker arm (not shown). The ball plunger 22 provides the end pivot point for an end pivot rocker arm.

The latch assembly 16 is arranged to selectively prevent or permit axial movement of the inner body member 14 into the longitudinal bore 18 of the outer body member 12. The outer body member 12 defines a transverse bore 24 generally perpendicular to the longitudinal bore 18. An enlarged portion 26 of the longitudinal bore provides room for radial movement of the latch members 40 and an annular latching surface 28.

Figure 7:
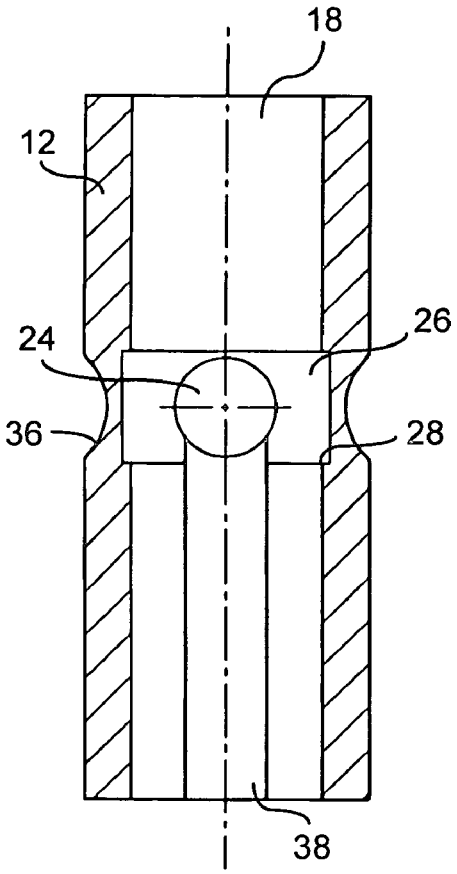
FIG. 7 is a longitudinal sectional view of the outer body member of FIG. 6.
Figure 6:
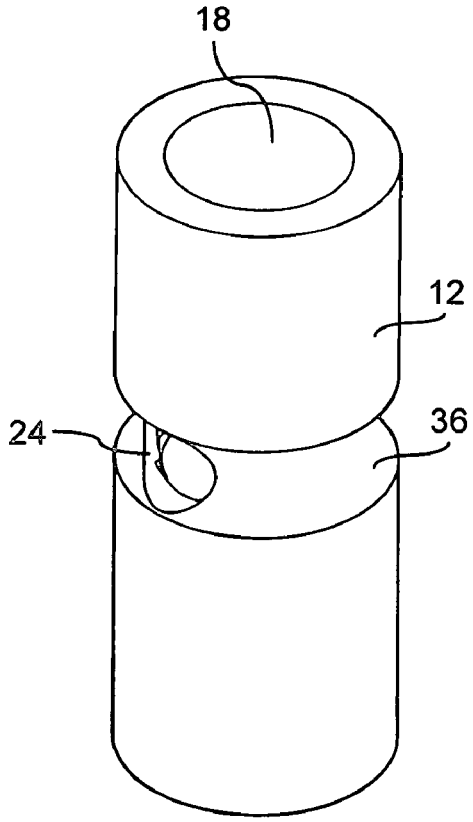
FIG. 6 is a perspective view of an outer body member of the valve deactivator assembly of FIGS. 1 and 2.
Figure 8:
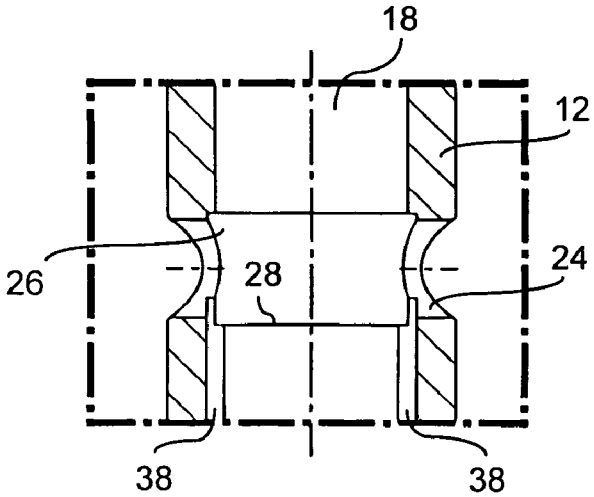
FIG. 8 is a partial enlarged longitudinal sectional view of the outer body member of FIG. 6, taken perpendicular to the sectional view of FIG. 7.

Diametrically opposed pistons 30 are arranged for radial sliding movement in the transverse bore 24. Each piston 30 includes a generally spherical outer end 32 and a substantially planar inner end 34. The outer end 32 of the piston is exposed to fluid pressure from an engine oil gallery (not shown). As best seen in FIGS. 6–8, the generally cylindrical outside surface of the outer body member 12 is interrupted by a circumferential groove 36 which ensures fluid communication between the engine oil gallery and the pistons 30. The pistons 30 are configured to translate a predetermined fluid pressure to an inward force sufficient to move the latch members 40 from a radially outward latched position to a radially inward unlatched position. The size and shape of the piston may be altered to conform to these variables. For example, a larger diameter piston will produce a greater inward force at a given fluid pressure than a smaller diameter piston.

Figure 4:
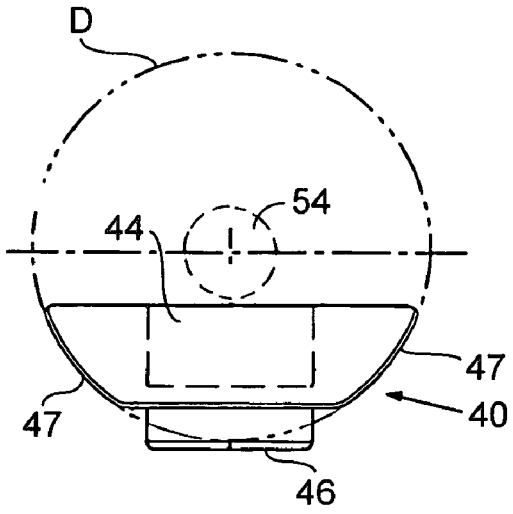
FIG. 4 is a top plan view of the latch member of FIG. 3.
Figure 5:
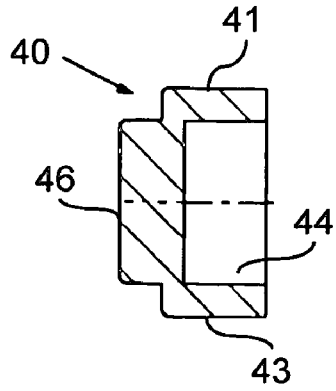
FIG. 5 is a sectional view of the latch member of FIGS. 3 and 4, taken along line 5—5 of FIG. 3.
Figure 3:
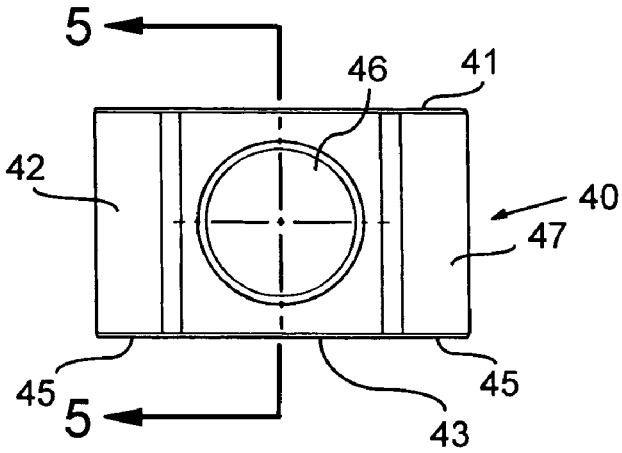
FIG. 3 is a side plan view of a latch member of the valve deactivator assembly of FIGS. 1 and 2.

The configuration of each latch member 40 is best shown in FIGS. 3–5. The latch members 40 are substantially identical and thus may be interchangeable. Each latch member 40 includes a radially protruding actuation surface 46 that bears on the inner end 34 of the adjacent piston. The latch members are semi-cylindrical in configuration as best shown in FIGS. 2 and 4. Flat truncated semi-circular upper and lower surfaces 41, 43 are respectively in contact with the bottom of the inner body member 14 and the latch support 50. The periphery of each latch member lower surface 43 provides arcuate shoulder portions 45 that engage angularly separated portions of the latching surface 28 inside the outer body member. The arcuate shoulder portions 45 of the latch member extend laterally to either side of the radially outwardly projecting actuated surface 46. The two diametrically opposed latch members 40 engage the latching surface 28 at four angularly separated areas. This configuration spreads the force of valve actuation over a large surface area and distributes forces around the circumference of the outer body member 12, reducing the likelihood of force concentrations and fatigue failure over the life of the valve deactivator assembly.

The latch members 40 are radially outwardly biased by a compressed spring 42 seated in a hollow 44 defined at the rear of each latch member. In the illustrated embodiment, the inner end 34 of the piston and actuated surface 46 of the latch members are substantially planar. This surface configuration permits the latch member 40 to slide axially relative to the piston 30 while the two are in contact. The surfaces 34, 46 need not be planar and any surface configuration that would facilitate axial relative motion between the piston inner end 34 and the actuated surface 46 of the latch member is compatible with the present invention.

The latch members 40 are supported against the bottom of the inner body member 14 by a latch support 50 extending across the longitudinal bore 18. The latch support 50 is biased against the latch members 40 by a compressed spring 52. This arrangement biases the inner body member 14 toward the axially extended position shown in FIG. 1. The plate-shaped latch support 50 includes an upwardly projecting stop 54 that limits radially inward movement of the latch members 40.

Figure 1:
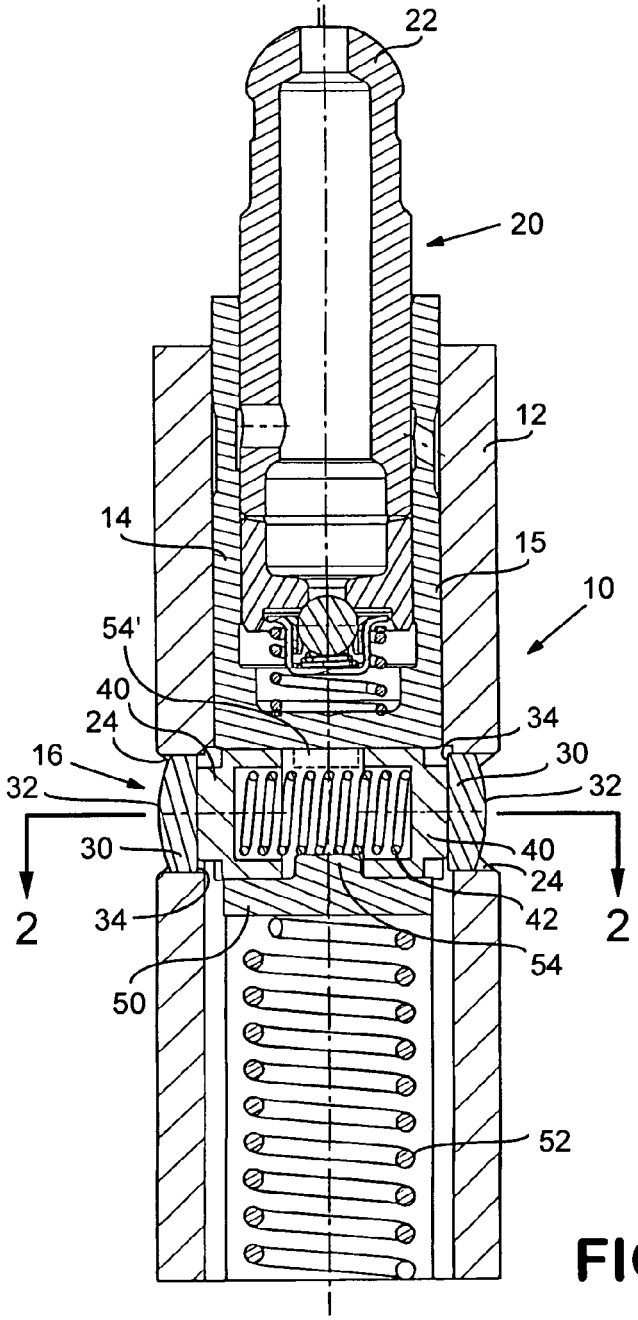
FIG. 1 is a longitudinal sectional view of a valve deactivator assembly according to aspects of the present invention.

The left hand portions of FIGS. 1 and 2 illustrate the piston 30 and latch member 40 in the latched position. In this position, the fluid pressure on the piston 30 is insufficient to compress the spring 42 and move the latch member 40 from its latched position. In the latched position, the shoulders 45 of the latch member engage the latching surface 28 as best shown in FIG. 2.

The right hand portions of FIGS. 1 and 2 illustrate the piston 30 and latch member 40 in their unlatched position. Fluid pressure on the outer end 32 of the piston is sufficient to compress the spring 42 and move the latch member 40 radially inwardly to the unlatched position. In the unlatched position, the shoulders 45 of the latch member are radially inwardly and disengaged from the latching surface 28. When both latch members 40 are in the unlatched position, the inner body member 14 is supported only by the latch support spring 52. Reciprocal movement in the valve train against an unlatched valve deactivator assembly 10 will force the inner body member 14 into the outer body member 12 against the bias of the latch support spring 52. Diametrically opposed axial slots 38 accommodate the protruding actuated surfaces 46 of the latch members. The slots 38 extend upwardly into the enlarged portion 26 of the longitudinal bore and communicate with the transverse bore 24. The slots 38 maintain the latch members 40 in alignment with the transverse bore 24 throughout their axial range of motion.

The latch support stop 54 defines the inward limit of movement for the latch members 40 as shown in the right hand portion of FIGS. 1 and 2. FIG. 1 also illustrates an alternative location for the stop 54' on the bottom of the inner body member 14. Since the inner end 34 of each piston is typically engaged against the actuated surface 46 of the latch members, the inward limit of latch member movement also defines an inward limit for piston travel. When unlatched, the inner body member 14, latch members 40 and latch support 50 move axially into the longitudinal bore 18 of the outer body member 12 against the bias of the latch support spring 52. During this movement, the latch member actuated surfaces 46 slide off of the inner ends 34 of the pistons and into the longitudinal slots 38 below the transverse bore 24. The inner body member 14 also moves downwardly so that its outside surface 15 is engaged in sliding contact with the inner end 34 of the pistons. Thus, the inner end 34 of the pistons are in contact with either the actuated surface 46 of the latch members or the outside surface 15 of the inner body member, or both, during axial movement of the inner body member 14 relative to the outer body member 12.

The disclosed latch members 40 provide multiple, angularly spaced engagement regions with the latching surface 28. The semi-cylindrical latch members 40 have arcuate upright surfaces 47 configured to slide inside the longitudinal bore 18 of the outer body member 12. The latch members 40 are configured to form portions of a circle D having a diameter substantially equal to the diameter of the longitudinal bore 18. The latch members 40 and latch support stop 54 are configured such that the latch members' 40 limit of inward movement puts the arcuate upright surfaces 47 of the latch members adjacent the inside surface of the longitudinal bore as shown in FIGS. 2 and 4. The latch members 40 are configured to support the inner body member 14 relative to the outer body member 12 when in a latched position. The illustrated latch member configuration provides a robust support to the inner body member 14 by spreading valve train actuation forces over a several angularly separated areas of the latching surface 28.

In a typical installation, the valve deactivator assembly 10 of present invention is employed to deactivate some of the valves in a multi-cylinder engine in which the valve train includes rocker arms for each of the intake and exhaust valves for each cylinder. Valve deactivator assemblies 10 are arranged to introduce lost motion in the valve train and prevent valve actuation. When deactivated, the engine valve remains closed under the influence of a valve-closing spring (not shown herein).

Those skilled in the art should understand that the invention is not limited to any particular valve deactivator or HLA configuration, except as is noted in the appended claims. Thus, the present invention is illustrated in conjunction with an HLA for use with an end pivot rocker arm, but the invention could also be utilized in, for example, a valve deactivating roller follower for a push rod type valve train.

An exemplary embodiment of the invention has been described for purposes of illustration. Various alterations and modifications of the invention will become apparent to those skilled in the art from the enclosed specification and Figures. It is intended that all such alterations and modifications are included in the invention insofar as they come within the scope of the appended claims.

What is claimed is:

1. A valve deactivator assembly for selectively coupling the reciprocal motion of a cam follower to a valve in an internal combustion engine, comprising:

an outer body member defining a longitudinal bore, a groove formed in an inner wall of said longitudinal bore and a transverse bore intersecting said longitudinal bore;

an inner body member arranged for axial movement in said longitudinal bore between an extended position and a collapsed position relative to said outer body member;

a piston disposed in said transverse bore for radial movement in response to fluid pressure, said piston having an inner end and an outer end exposed to said fluid pressure;

a latch support arranged in said longitudinal bore, said latch support being axially moveable and biased toward said inner body member;

a latch member disposed in said longitudinal bore intermediate said latch support and said inner body member and having an actuated surface and a shoulder configured to engage said groove;

wherein said piston moves radially inwardly in response to fluid pressure of a pre-determined magnitude at said outer end, said piston inner end bearing on said latch member actuated surface to move said latch member from a latched position in which said shoulder is engaged with said groove to an unlatched position in which said shoulder is radially inward of and disengaged from said groove, said latch member in said latched position rigidly supporting said inner body member in said extended position and said latch member in said unlatched position allowing said inner body member, latch member and latch support to move axially into said longitudinal bore past said circumferential groove into said collapsed position.

2. The valve deactivator assembly of claim 1, wherein said longitudinal bore includes an axial slot communicating with said transverse bore and configured to guide said latch member during movement between said extended and collapsed positions and prevent rotation of said latch member relative to said outer body member.

3. The valve deactivator assembly of claim 1, wherein said piston outer end is generally spherically shaped.

4. The valve deactivator assembly of claim 1, comprising a second piston and second latch member diametrically opposed to said piston and latch member and substantially identical thereto and a compressed spring biasing said latch member and second latch member radially outwardly.

5. The valve deactivator assembly of claim 1, wherein said inner body member includes an outside surface and one of said latch member actuated surface or inner body outside surface is in contact with said piston inner end when said latch member is in said unlatched position.

6. The valve deactivator assembly of claim 1, comprising a stop arranged to limit radially inward movement of said latch member.

7. The valve deactivator assembly of claim 1, wherein said transverse bore is generally circular and has a diameter, said piston is configured for close sliding reception in said transverse bore, and said diameter is selected so that said piston generates a pre-determined unlatching force when exposed to said pre-determined magnitude of fluid pressure.

8. The valve deactivator assembly of claim 6, wherein said stop is located on either of said inner body member or said latch support or both said inner body member and said latch support.

9. The valve deactivator assembly of claim 1, wherein said inner body member includes a hydraulic lash adjuster.

10. The valve deactivator assembly of claim 1, wherein said groove includes a latching surface substantially perpendicular to said longitudinal groove and said shoulder engages said latching surface at a plurality of angularly spaced locations.

11. An improved valve deactivator assembly for selectively coupling the reciprocal motion of a cam follower to a valve in an internal combustion engine, said valve deactivation assembly including:

an outer body member defining a longitudinal bore;

an inner body member axially moveable within said outer body member;

a spring biasing said inner body member toward an axially extended position relative to said outer body member;

a latch assembly disposed between said spring and said inner body member, said latch assembly including a radially moveable latch member biased toward a latched position in which said latch member rigidly supports said inner body member in said extended position; and a source of pressurized fluid operable to move said latch member to an unlatched position, wherein the improvement comprises:

a piston having an outer end exposed to said pressurized fluid and an inner end adjacent said latch member, said piston delivering an unlatching force from said pressurized fluid to move said latch member to said unlatched position, wherein said latch member in said unlatched position permits said inner body member and latch member to collapse into said outer body member past said piston.

12. The improved valve deactivator assembly of claim 11, wherein said piston inner end remains in sliding contact with said latch member or said lower body member during said axial movement.

13. The improved valve deactivator assembly of claim 11, comprising a second piston, a second latch member diametrically opposed to said piston and latch member and substantially identical thereto and a compressed spring biasing said latch member and second latch member radially outwardly toward said latched position.

14. The improved valve deactivator assembly of claim 11, wherein said longitudinal bore includes an axial slot configured to guide said latch member during axial movement and prevent rotation of said latch member relative to said outer body member.

15. The improved valve deactivator assembly of claim 11, wherein said piston outer end is generally spherically shaped.

16. The improved valve deactivator assembly of claim 11, wherein said inner body member includes a hydraulic lash adjuster.

17. The improved valve deactivator assembly of claim 11, comprising a stop arranged to limit radially inward movement of said latch member.

18. The improved valve deactivator assembly of claim 17, wherein said stop is located on either of said inner body member or said latch support or both said inner body member and said latch support.

19. The improved valve deactivator assembly of claim 11, wherein said longitudinal bore defines a circumferential latching surface substantially perpendicular to said longitudinal groove and said shoulder engages said latching surface at a plurality of angularly spaced locations.

20. The improved valve deactivator assembly of claim 13, wherein said longitudinal bore defines a circumferential latching surface substantially perpendicular to said longitudinal groove and said shoulders engage said latching surface at a plurality of angularly spaced locations.

* * * * *